US009307885B2

(12) United States Patent
Welch

(10) Patent No.: US 9,307,885 B2
(45) Date of Patent: Apr. 12, 2016

(54) ROTATING FILTER ASSEMBLY FOR A DISHWASHER

(75) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1129 days.

(21) Appl. No.: 13/348,025

(22) Filed: Jan. 11, 2012

(65) Prior Publication Data

US 2013/0174879 A1 Jul. 11, 2013

(51) Int. Cl.
*A47L 15/42* (2006.01)

(52) U.S. Cl.
CPC ..... *A47L 15/4204* (2013.01); *A47L 15/4208* (2013.01); *A47L 15/4225* (2013.01)

(58) Field of Classification Search
CPC ..... A47L 15/4202; A47L 15/4204; A47L 15/4208; A47L 15/00–15/508; B01D 33/0041; B01D 33/0067; B01D 33/15; B01D 33/46; B01D 33/466
See application file for complete search history.

(56) References Cited

U.S. PATENT DOCUMENTS

| | | | |
|---|---|---|---|
| 4,228,962 | A | 10/1980 | Dingler et al. |
| 6,418,943 | B1 | 7/2002 | Miller |
| 7,594,513 | B2 | 9/2009 | VanderRoest et al. |
| 2006/0005863 | A1 | 1/2006 | Gurubatham et al. |
| 2010/0224223 | A1 | 9/2010 | Kehl et al. |
| 2010/0252081 | A1 | 10/2010 | Classen et al. |

FOREIGN PATENT DOCUMENTS

| | | | |
|---|---|---|---|
| EP | 1386575 | B1 | 2/2004 |
| EP | 2462857 | A1 | 6/2012 |

OTHER PUBLICATIONS

German Search Report for Counterpart DE102012110890, Jan. 24, 2013.

*Primary Examiner* — Michael Barr
*Assistant Examiner* — Spencer Bell

(57) ABSTRACT

A dishwasher with a tub at least partially defining a washing chamber, a liquid spraying system supplying a spray of liquid to the washing chamber, a liquid recirculation system defining a recirculation flow path, and a liquid filtering system. The liquid filtering system includes a rotating filter disposed in the recirculation flow path to filter the liquid.

17 Claims, 6 Drawing Sheets

ROTATING FILTER ASSEMBLY FOR A DISHWASHER

BACKGROUND OF THE INVENTION

A dishwasher is a domestic appliance into which dishes and other cooking and eating wares (e.g., plates, bowls, glasses, flatware, pots, pans, bowls, etc.) are placed to be washed. A dishwasher may include a filter system to remove soils from liquid circulated onto the dishes.

BRIEF DESCRIPTION OF THE INVENTION

In one embodiment, a dishwasher includes a tub at least partially defining a washing chamber, a liquid spraying system supplying a spray of liquid to the washing chamber, a liquid recirculation system recirculating the sprayed liquid from the washing chamber to the liquid spraying system to define a recirculation flow path, and a liquid filtering system including a shroud defining an interior and having an inlet opening facing downstream to the recirculation flow path, a rotating filter having an upstream surface and a downstream surface and located within the interior relative to the recirculation flow path such that the recirculation flow path passes through the filter from the upstream surface to downstream surface to effect a filtering of the sprayed liquid, and a first flow diverter overlying at least a portion of the filter to form a backflow zone where the liquid flows from the downstream surface to the upstream surface, wherein the first flow diverter is located such that the backflow zone is positioned relative to the inlet opening to retard entry of foreign objects in the liquid into the inlet opening along the recirculation flow path.

In one embodiment, a dishwasher includes a tub at least partially defining a washing chamber, a liquid spraying system supplying a spray of liquid to the washing chamber, a liquid recirculation system recirculating the sprayed liquid from the washing chamber to the liquid spraying system to define a recirculation flow path, and a rotating filter having a first filter element forming an upstream surface and a second filter element forming a downstream surface and located in the recirculation flow path such that the recirculation flow path passes through the filter from the upstream surface to the downstream surface to effect a filtering of the sprayed liquid.

DESCRIPTION OF EMBODIMENTS OF THE INVENTION

Figure 1:
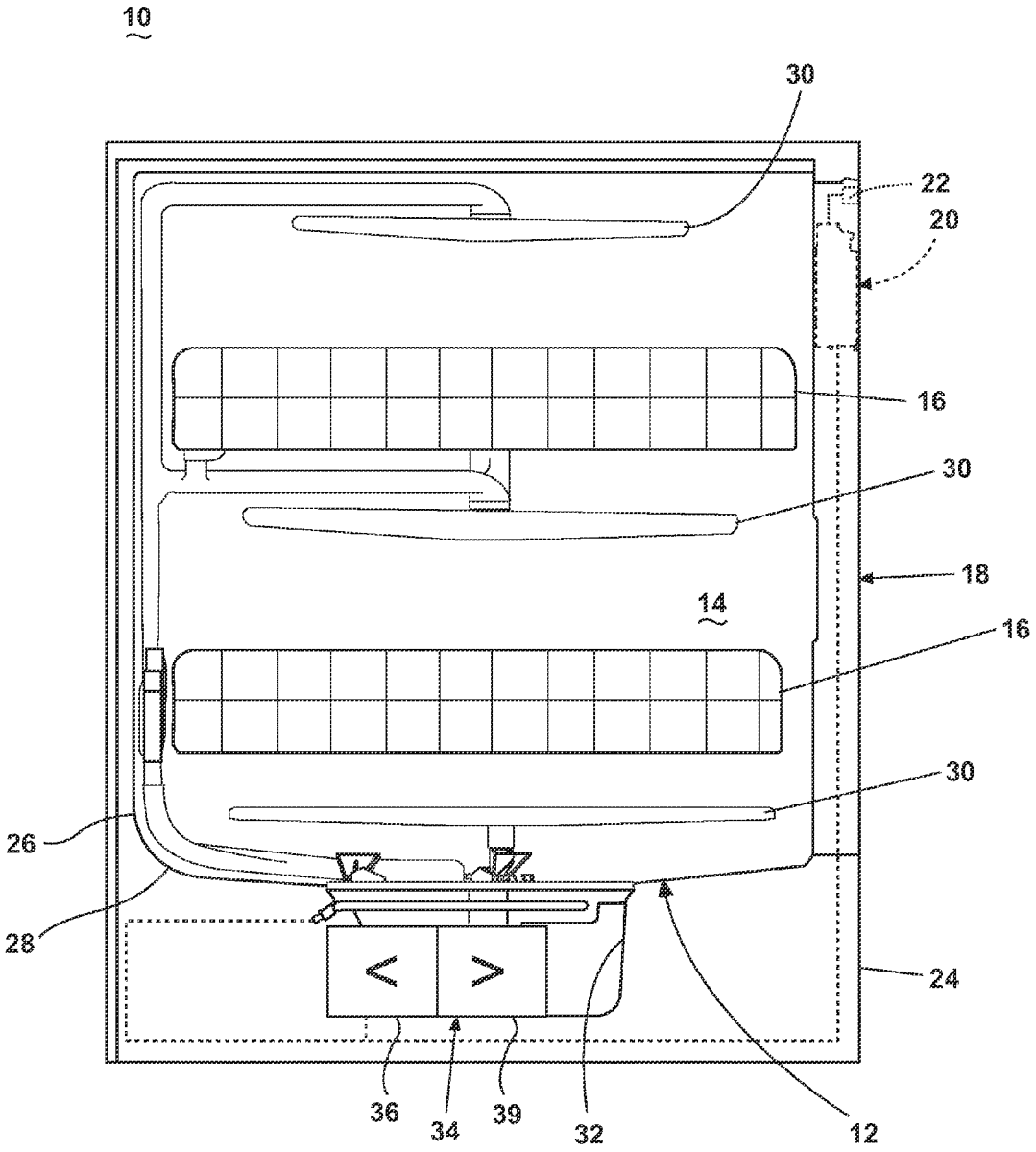
FIG. 1 is a cross-sectional view of a dishwasher according to an embodiment of the invention.

Referring to FIG. 1, a dishwasher 10 is shown. The dishwasher 10 has a tub 12 that at least partially defines a treating chamber 14 into which a user may place utensils to be washed. As used in this description, the term "utensil(s)" is intended to be generic to any item, single or plural, that may be treated in the dishwasher 10, including, without limitation, dishes, plates, pots, bowls, pans, glassware, and silverware. The dishwasher 10 may include a number of dish racks 16 located in the tub 12. The dish racks 16 are typically mounted for slidable movement in and out of the treating chamber 14 for ease of loading and unloading. Other utensil holders may be provided, such as a silverware basket.

A door 18 is hinged to the lower front edge of the tub 12. The door 18 permits user access to the tub 12 to load and unload the dishwasher 10. The door 18 also seals the front of the dishwasher 10 during a cycle of operation of the dishwasher 10. A controller 20 and a control panel or user interface 22 may be included in the dishwasher 10. The controller 20 may be operably coupled with various components of the dishwasher 10 to implement a cycle of operation. The controller 20 may be located within the door 18 as illustrated or it may be located in any suitable alternative location. The controller 20 may also be operably coupled with a user interface 22 for receiving user-selected inputs and communicating information to the user. The user interface 22 may include operational controls such as dials, lights, switches, and displays enabling a user to input commands, such as a cycle of operation, to the controller 20 and receive information.

A machine compartment 24 may be located below the tub 12. The machine compartment 24 may be sealed from the tub 12. In other words, unlike the tub 12, which is filled with fluid and exposed to spray during a cycle of operation of the dishwasher 10, the machine compartment 24 does not fill with fluid and is not exposed to spray. The tub 12 includes a number of side walls 26 extending upwardly from a bottom wall 28 to define the treating chamber 14. A liquid spraying system for supplying a spray of liquid to the treating chamber 14 may be included in the dishwasher 10 and is illustrated as including a spray assembly 29 including multiple spray arms 30. The liquid spraying system may include additional spray assemblies and such spray assemblies are set forth in detail in U.S. Pat. No. 7,594,513, issued Sep. 29, 2009, and titled "Multiple Wash Zone Dishwasher," which is incorporated herein by reference in its entirety.

A recirculation system may be provided for recirculating liquid from the treating chamber 14 to the spray system and to create a recirculation flow path between them. The recirculation system may include a sump 32 and a pump assembly 34. The sump 32 collects the liquid sprayed in the treating chamber 14 and may be formed by a sloped or recess portion of the bottom wall 28 of the tub 12. The pump assembly 34 may include both a drain pump assembly 36 and a recirculation pump and filter assembly 38. The drain pump 36 may draw liquid from the sump 32 and pump the liquid out of the dishwasher 10 to a household drain line (not shown). The recirculation pump and filter assembly 38 may draw liquid from the sump 32 and the liquid may be supplied to the liquid spraying system. While not shown, a liquid supply system may include a water supply conduit coupled with a household water supply for supplying water to the treating chamber 14.

Figure 2:
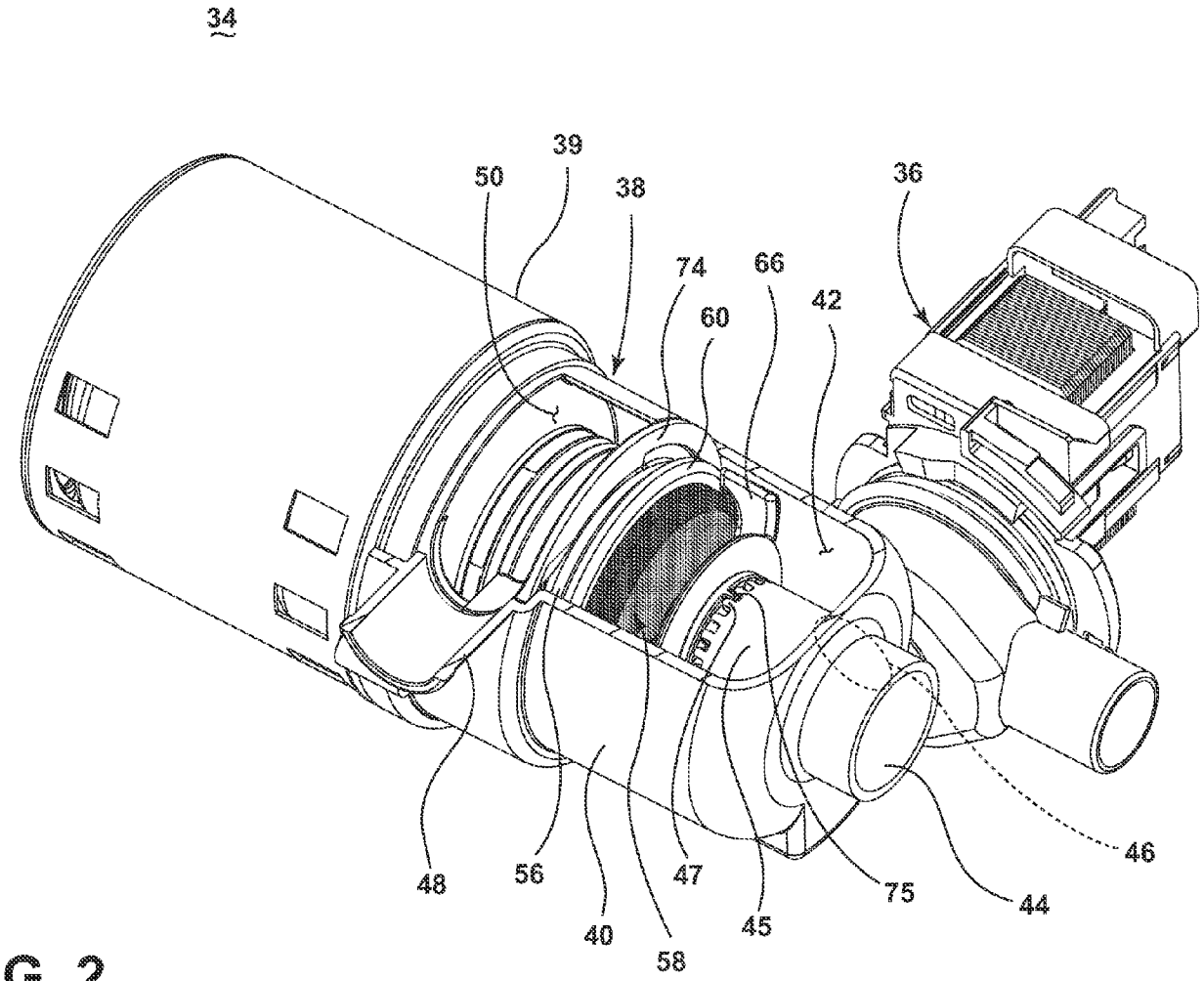
FIG. 2 is a perspective view of an embodiment of a pump and filter assembly of the dishwasher of FIG. 1 with portions cut away for clarity.

Referring now to FIG. 2, the drain pump assembly 36 and the recirculation pump and filter assembly 38 are shown removed from the dishwasher 10. The recirculation pump and filter assembly 38 includes a recirculation pump 39 that is secured to a filter housing 40, which are both shown partially cutaway for clarity. The filter housing 40 defines a filter chamber 42 that extends the length of the filter housing 40 and includes an inlet port 44, a drain outlet port 46, and a recirculation outlet port 48. The inlet port 44 is configured to be coupled to a fluid hose (not shown) extending from the sump 32. The filter chamber 42, depending on the location of the recirculation pump and filter assembly 38, may functionally be part of the sump 32 or replace the sump 32. The drain outlet port 46 for the recirculation pump 38, which may also be considered the drain pump inlet port, may be coupled to the drain pump 36 such that actuation of the drain pump 36 drains the liquid and any foreign objects within the filter chamber 42. The recirculation outlet port 48 is configured to receive a fluid hose (not shown) such that the recirculation outlet port 48 may be fluidly coupled to the liquid spraying system including the spray arms 30. The recirculation outlet port 48 is fluidly coupled to an impeller chamber 50 of the recirculation pump 39 such that when the recirculation pump 39 is operated liquid may be supplied to the spray arms 30. In this manner, the recirculation pump 39 includes an inlet fluidly coupled to the tub 12 and an outlet fluidly coupled to the liquid spraying system to recirculate liquid from the tub 12 to the treating chamber 14.

Figure 3:
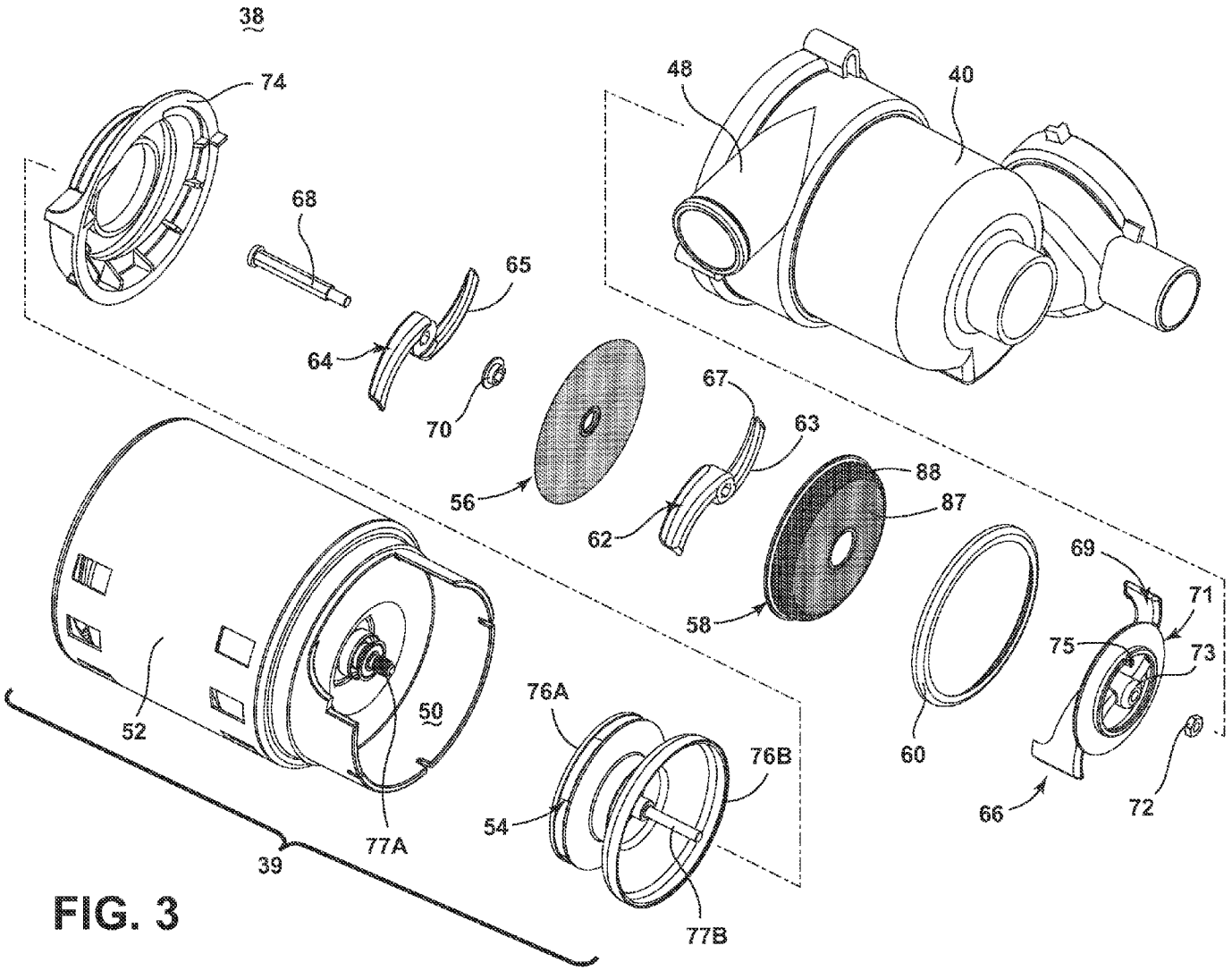
FIG. 3 is an exploded view of the pump and filter assembly of FIG. 2.

FIG. 3 may more clearly illustrate that the recirculation pump 39 may include a motor 52 and an impeller 54. A disc-shaped rotating filter 56 and a rotating pre-filter 58 may be included in the recirculation pump and filter assembly 38. The disc-shaped rotating filter 56 and the rotating pre-filter 58 may be joined together by a ring fastener 60 and may collectively form a filter assembly 61. A first flow diverter 62, a second flow diverter 64, and a third flow diverter 66, as well as a shaft 68, a bearing 70, a locking nut 72, and a separator ring 74 may also be included in the recirculation pump and filter assembly 38. This view best illustrates that the first flow diverter 62 and second flow diverter 64 are S-shaped. Further, it may be seen that the first and second flow diverters 62 and 64 each have an increased width body portion 63 and 65, respectively, and that a scooped portion 67 may be included on the first flow diverter 62. The third flow diverter has a first portion 69 that is S-shaped and a hollow coupler 71 that includes a first coupling 73 and a second coupling 75.

Figure 4:
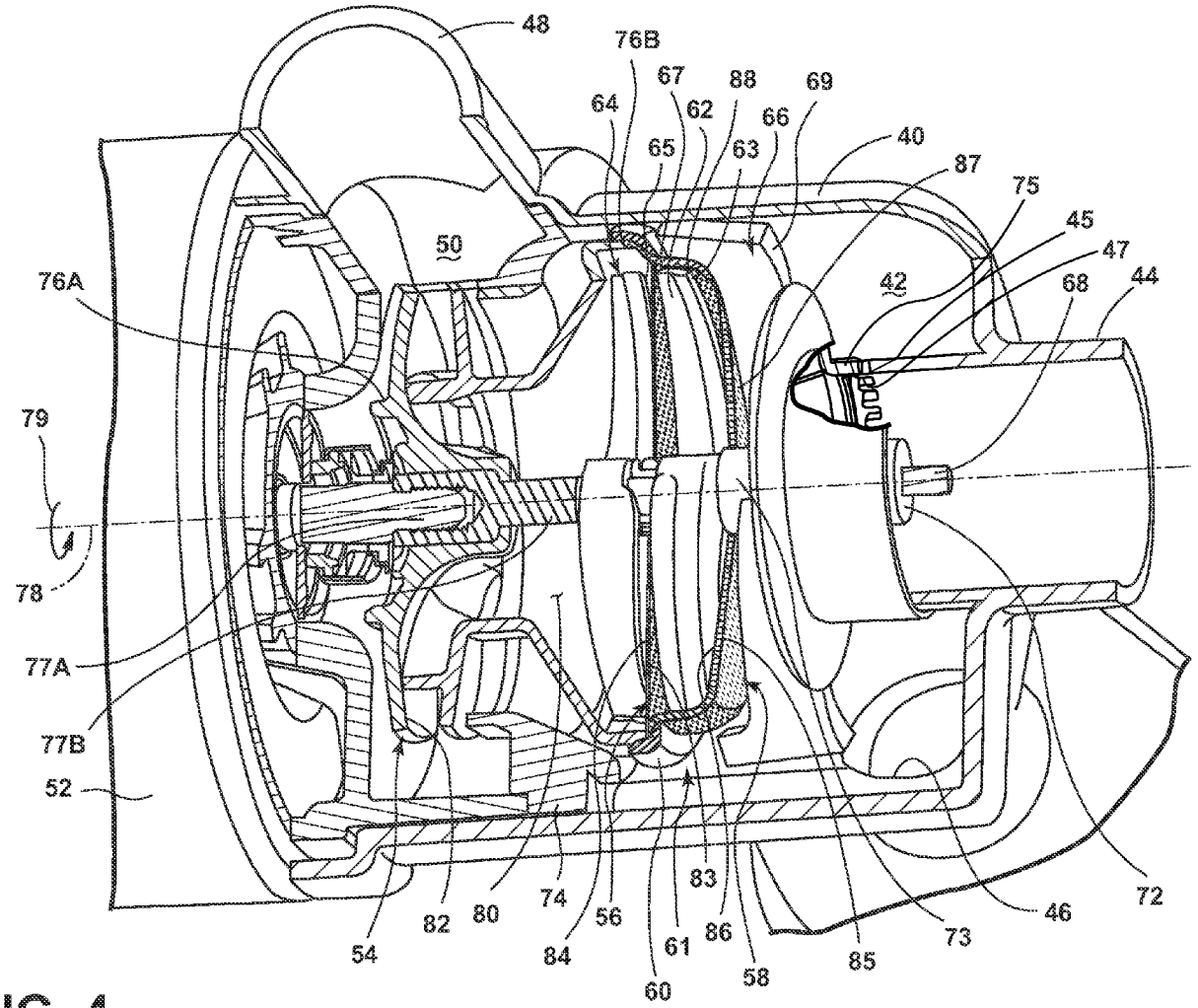
FIG. 4 is a cross-sectional view of the pump and filter assembly of FIG. 2 taken along the line 5-5 shown in FIG. 3.

As illustrated more clearly in FIG. 4, the impeller 54 extends from a back end 76A to a front end 76B and may be rotatably driven through a drive shaft 77A by the motor 52. The motor 52 may act on the drive shaft 77A to rotate the impeller 54 about an imaginary axis 78 in the direction indicated by arrow 79. More specifically, the drive shaft 77A may be operably coupled to an impeller coupling 77B portion of the impeller 54 and may operate to rotate the impeller 54 through the impeller coupling 77B. The motor 52 may be configured to rotate the impeller 54 about the axis 78 in the range of 3000 rpm, which may vary between 1000 to 5000 rpm and that the speed of rotation is not limiting to the embodiments of the invention.

The front end 76B of the impeller 54 is positioned in the filter chamber 42 and has an inlet opening 80 formed in the center thereof. A number of vanes extend to an outer edge 82 of the impeller 54.

The front end 76B of the impeller 54 may be received within the ring fastener 60 or may otherwise be operably coupled to the filter assembly 61 such that the filter assembly 61 may be operably coupled to the impeller 54 such that rotation of the impeller 54 effects the rotation of the disc-shaped rotating filter 56 and the rotating pre-filter 58. Alternatively, the impeller coupling portion 77B of the impeller 54 may be operably coupled to the filter assembly 61 to provide for rotation of the filter assembly 61. The disc-shaped rotating filter 56 may include a filter sheet forming an upstream surface 83 and a downstream surface 84. The rotating pre-filter 58 may also include a filter sheet forming an outer or upstream surface 85 and an inner or downstream surface 86. The filter assembly 61 may be located in the recirculation flow path such that the recirculation flow path passes through the rotating pre-filter 58 from the upstream surface 85 to the downstream surface 86 to effect a first filtering of the sprayed liquid and passes through the disc-shaped rotating filter 56 from the upstream surface 83 to the downstream surface 84 to effect additional filtering of the sprayed liquid.

The rotating pre-filter 58 may be in a spaced relationship from the disc-shaped rotating filter 56. By way of non-limiting example, the rotating pre-filter 58 has been illustrated as including a disc-shaped top 87 and a peripheral wall 88 extending from the disc-shaped top 87 towards the disc-shaped rotating filter 56. The bottom of the peripheral wall 88 is illustrated as being operably coupled to the impeller 54 through the ring fastener 60. The disc-shaped rotating filter 56 has been illustrated as being located adjacent the bottom of the peripheral wall 88 and as extending to the edges of the peripheral wall 88 such that liquid that is filtered by the rotating pre-filter 58 must then be filtered by the disc-shaped rotating filter 56 before being recirculated to the liquid spraying system.

The rotating pre-filter 58 and disc-shaped rotating filter 56 may be structurally different from each other, may be made of different materials, and may have different properties attributable to them. For example, the rotating pre-filter 58 may be a courser filter than the disc-shaped rotating filter 56. Both the rotating pre-filter 58 and disc-shaped rotating filter 56 may be perforated and the perforations of the rotating pre-filter 58 may be different from the perforations of the disc-shaped rotating filter 56, with the size of the perforations providing the difference in filtering. For example, it is contemplated that the perforations of the rotating pre-filter 58 may be larger than those of the disc-shaped rotating filter 56 such that the pre-filter is a coarse screen filter and the disc-shaped filter is a fine screen filter. Further yet, the rotating pre-filter 58 may have multiple sizes of perforations including that the perforations in the disc-shaped top 87 may be smaller than those in the peripheral wall 88.

It is also contemplated that the rotating pre-filter 58 may be more resistant to foreign object damage than the disc-shaped rotating filter 56. The resistance to foreign object damage may be provided in a variety of different ways. The rotating pre-filter 58 may be made from a different or stronger material than the disc-shaped rotating filter 56. The rotating pre-filter 58 may be made from the same material as the disc-shaped rotating filter 56, but having a greater thickness. The distribution of the perforations may also contribute to the rotating pre-filter 58 being stronger. The perforations of the rotating pre-filter 58 may leave a more non-perforated area for a given surface area than the disc-shaped rotating filter 56, which may provide the rotating pre-filter 58 with greater strength. It is also contemplated that the perforations of the rotating pre-filter 58 may be arranged to leave non-perforated bands on the rotating pre-filter 58, with the non-perforated bands functioning as strengthening ribs (not shown).

The bearing 70 may be mounted in a center of the disc-shaped rotating filter 56 and may rotatably receive the stationary shaft 68. In this way, the filter assembly 61 is rotatably mounted to the stationary shaft 68 with the bearing 70. The stationary shaft 68 is mounted to the third flow diverter 66 by the locking nut 72. More specifically, the second coupling 75 is illustrated as engaging teeth 47 located on the internal portion 45 of the inlet port 44 while the shaft 68 may be operably coupled to the first coupling 73 of the hollow coupler 71. The first flow diverter 62 and the second flow diverter 64 are also mounted on the shaft 68 and thus are also held stationary. The shaft 68 may be of hexagonal design and the first and second flow diverters 62 and 64 may be mounted through use of hexagonal openings onto the shaft 68 such that they may be held stationary on the shaft 68. The impeller coupling 77B rotates inside the stationary shaft 68 just as a shaft in a journal bearing and allows for the location of the flow diverters 62, 64, and 66 on the same axis 78 as the rotating pre-filter 58 and the disc-shaped rotating filter 56. When assembled, the first flow diverter 62 may overlie a portion of the upstream surface 83 and the second flow diverter 64 may overlie a portion of the downstream surface 84. The first and second flow diverters 62 and 64 may be arranged such that they have matching orientations on opposite sides of the disc-shaped rotating filter 56. The third flow diverter 66 may be spaced from the upstream surface 85 of the rotating pre-filter 58 and may be arranged such that the s-shaped first portion 69 may have a matching orientation to that of the second flow diverter 64.

In operation, wash liquid, such as water and/or wash chemistry (i.e., water and/or detergents, enzymes, surfactants, and other cleaning or conditioning chemistry), enters the tub 12 and flows into the sump 32 to the inlet port 44. The liquid passes through the hollow coupler 71 to the filter chamber 42. As the filter chamber 42 fills, liquid passes through the perforations in the rotating pre-filter 58 and the disc-shaped rotating filter 56. After the filter chamber 42 is completely filled and the sump 32 is partially filled with liquid, the dishwasher 10 activates the motor 52. During an operation cycle, a mixture of liquid and soil particles may advance from the sump 32 into the filter chamber 42 to fill the filter chamber 42.

Activation of the motor 52 causes the impeller 54 and the filter assembly 61 to rotate. The rotation of the impeller 54 about the axis 78 draws fluid from the filter chamber 42 into the inlet opening 80 where the fluid is then forced by the rotation of the impeller 54 outward and fluid exiting the impeller 54 is advanced out of the impeller chamber 50 through the recirculation outlet port 48 to the spray arms 30. When liquid is delivered to the spray arms 30, it is expelled from the spray arms 30 onto any utensils positioned in the treating chamber 14. Liquid removes soil particles located on the utensils, and the mixture of liquid and soil particles falls onto the bottom wall 28 of the tub 12. The sloped configuration of the bottom wall 28 directs that mixture into the sump 32.

The separator ring 74 acts to separate the filtered liquid in the impeller chamber 50 from the mixture of liquid and soils in the filter chamber 42. The recirculation pump 39 is fluidly coupled downstream of the disc-shaped rotating filter 56 and the rotating pre-filter 58 and if the recirculation pump 39 is shut off then any liquid not expelled will settle in the filter chamber 42. Any soils that are located between the rotating pre-filter 58 and the disc-shaped rotating filter 56 may leave the filter assembly 61 through the larger perforations in the peripheral wall 88.

Figure 5:
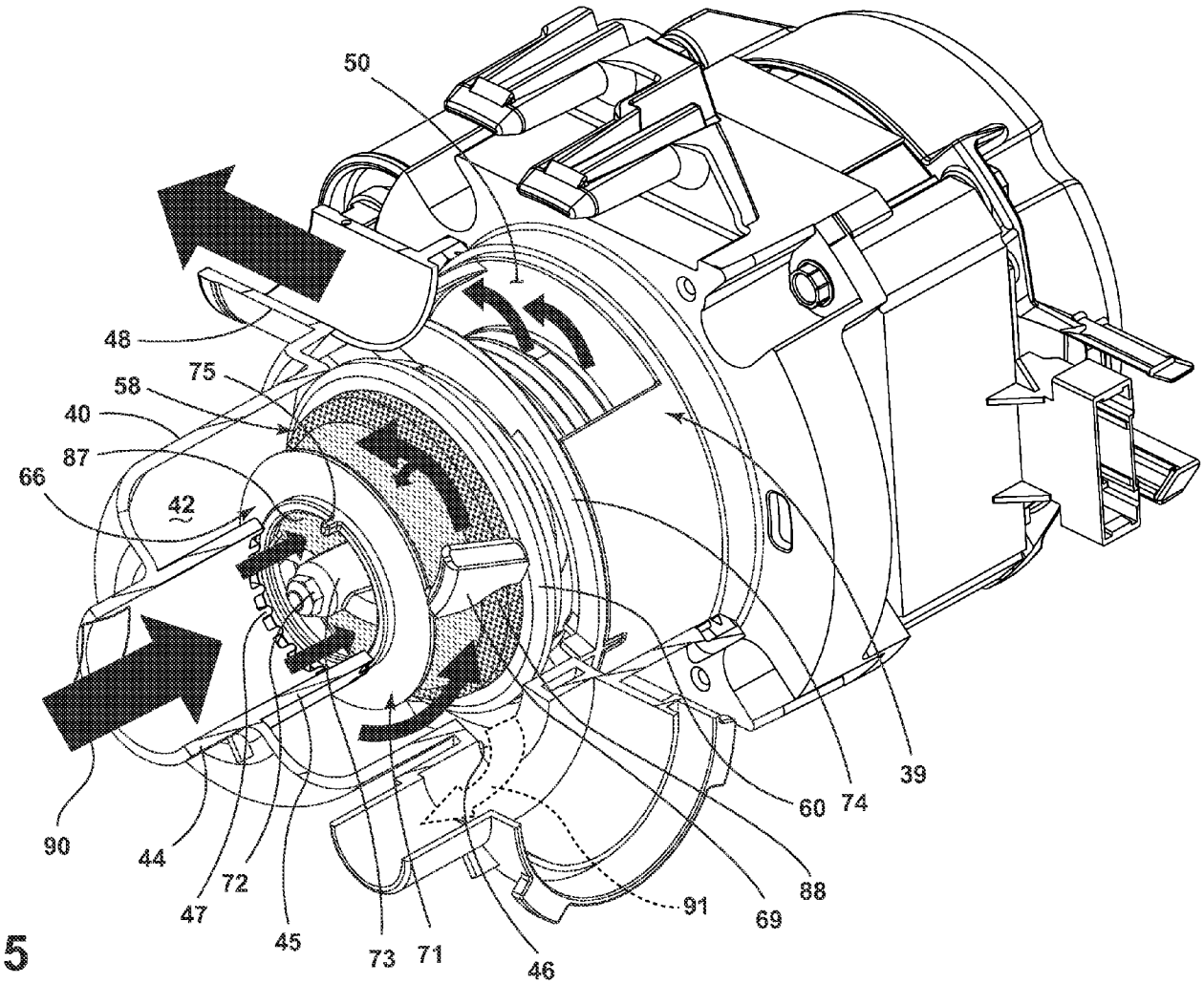
FIG. 5 is a perspective view of the assembled pump and filer assembly of FIG. 2 with a portion removed to better illustrate flow paths within the assembly.

FIG. 5 more clearly illustrates a portion of the recirculation flow path indicated by arrows 90 and a portion of the drain path indicated by arrows 91. The liquid is shown as traveling along the recirculation flow path into the filter chamber 42 from the inlet port 44. The rotation of the filter assembly 61, which is illustrated in the counter-clockwise direction, causes the liquid and soils therein to rotate in the same direction within the filter chamber 42. The recirculation flow path is thus illustrated as circumscribing at least a portion of the third flow diverter 66 and the filter assembly 61. It is most likely that some of the liquid in the recirculation flow path may make one or more complete trips around the third flow diverter 66 and the filter assembly 61 prior to being filtered. The number of trips is somewhat dependent upon the suction provided by the recirculation pump 39 and the rotation of the filter assembly 61.

Figure 6:
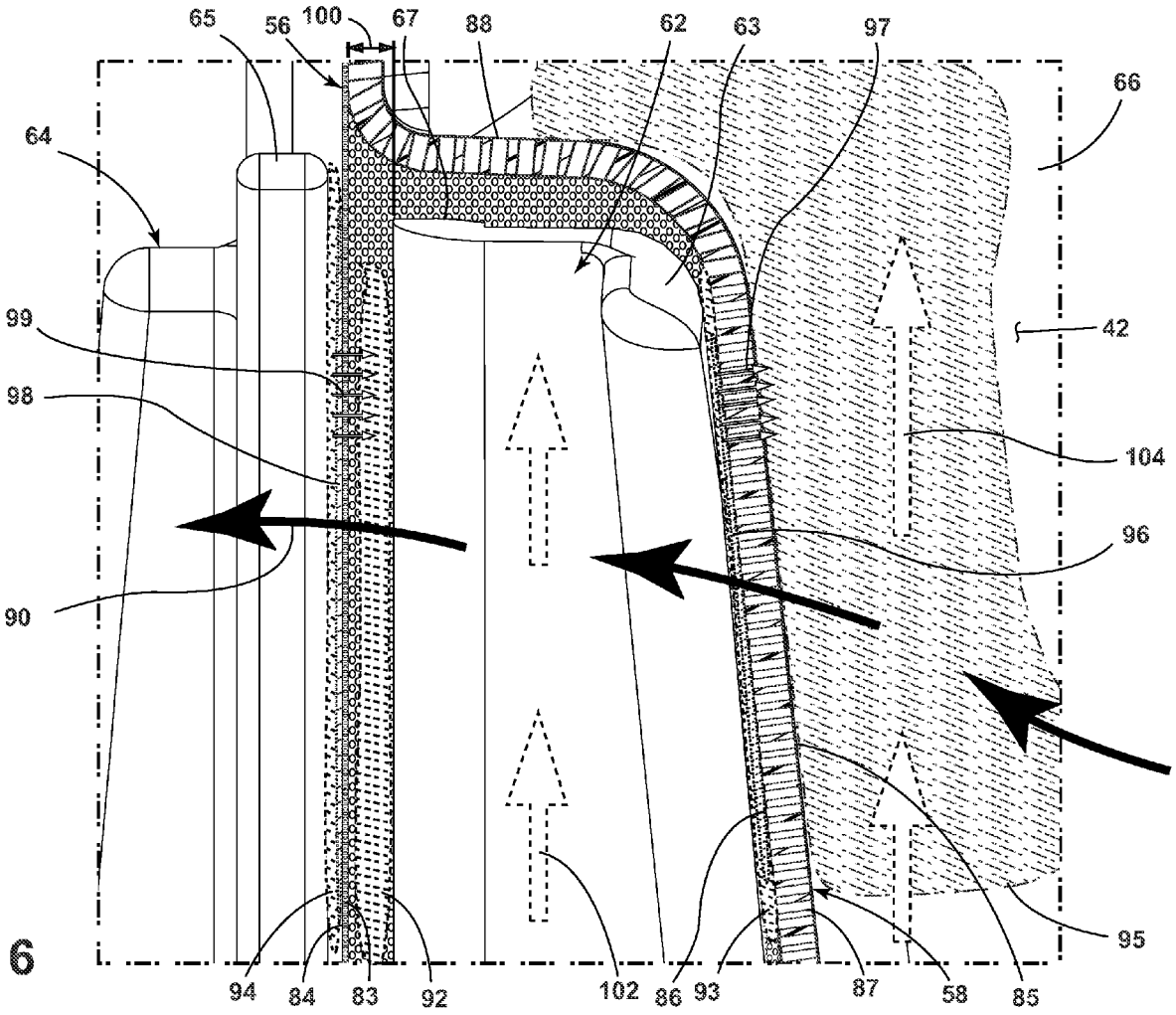
FIG. 6 is a cross-sectional elevation view of a portion of the pump and filter assembly of FIG. 2.

FIG. 6 illustrates more clearly the relationship between the disc-shaped rotating filter 56, the rotating pre-filter 58, the first flow diverter 62, second flow diverter 64, and third flow diverter 66 and the flow of the liquid along the recirculation flow path as the recirculation flow path passes through the rotating pre-filter 58 from the upstream surface 85 to the downstream surface 86 and through the disc-shaped rotating filter 56 from the upstream surface 83 to the downstream surface 84 into the inlet opening 80 of the impeller 54. It will be understood that the rotating pre-filter 58 fluidly separates the inlet port 44 from the disc-shaped rotating filter 56 such that liquid flowing from the inlet port 44 to the disc-shaped rotating filter 56 must pass through the rotating pre-filter 58 from the upstream surface 85 to the downstream surface 86. While fluid is permitted to pass through the rotating pre-filter 58, the size of the perforations prevents some soil particles from moving towards the disc-shaped rotating filter 56. As a result, those soil particles accumulate on the upstream surface 85 of the rotating pre-filter 58 and cover the perforations of the rotating pre-filter 58, thereby preventing fluid from passing through the rotating pre-filter 58. The same holds true for the disc-shaped rotating filter 56 in that the size of the perforations in the disc-shaped rotating filter 56 prevents some soil particles from moving towards the inlet opening 80. As a result, those soil particles accumulate on the upstream surface 83 of the disc-shaped rotating filter 56.

Multiple arrows 90 generally illustrate the travel of liquid along the recirculation flow path through the rotating pre-filter 58 and disc-shaped rotating filter 56. Various zones created in the filter chamber 42 during operation are illustrated and include: a first shear force zone 92, a second shear force zone 93, a third shear force zone 94, a fourth shear force zone 95, a first pressurized zone 96, and a second pressurized zone 98. These zones impact the travel of the liquid along the liquid recirculation flow path. It will be understood that the liquid flowing over the first flow diverter 62, second flow diverter 64, and third flow diverter 66 and through the rotating pre-filter 58 and disc-shaped rotating filter 56 may create such zones.

More specifically, the first flow diverter 62 is spaced from the upstream surface 83 of the disc-shaped rotating filter 56 and liquid passing between the first flow diverter 62 and the upstream surface 83 applies a greater shear force on the upstream surface 83 than liquid in an absence of the first flow diverter 62 and the first shear force zone 92 is created. As the first flow diverter 62 is also spaced from the downstream surface 86 of the rotating pre-filter 58 liquid passing between the first flow diverter 62 and the downstream surface 86 applies a greater shear force on the downstream surface 86 than liquid in an absence of the first flow diverter 62 and the second shear force zone 93 is created. Similarly, the second flow diverter 64 overlies a portion of the downstream surface 84 of the disc-shaped rotating filter 56 and liquid passing between the second flow diverter 64 and the downstream surface 84 applies a greater shear force on the downstream surface 84 than liquid in an absence of the second flow diverter 64 and the third shear force zone 94 is created. Further yet, the third flow diverter 66 is spaced from the upstream surface 85 of the rotating pre-filter 58 and applies a greater shear force on the upstream surface 85 of the rotating pre-filter 58 than liquid in an absence of the third flow diverter 66 and the fourth shear force zone 95 is created. In this manner, the flow diverters 62, 64, and 66 act as a first artificial boundaries to portions of the filter assembly 61.

Each shear force zone 92, 93, 94, and 95 is formed by the significant increase in angular velocity of the liquid in the relatively short distance between the first, second, and third flow diverters 62, 64, and 66 and the rotating pre-filter 58 and disc-shaped rotating filter 56, respectively. The increased shear force zones are created because the liquid in the increased shear force zones has an angular speed profile of zero where it is constrained at by the corresponding flow diverter to approximately 3000 rpm at the surface of the rotating pre-filter 58 or disc-shaped rotating filter 56, which requires substantial angular acceleration, which locally generates the increased shear forces on the corresponding surface of the rotating pre-filter 58 and disc-shaped rotating filter 56, respectively. Thus, the proximity of the flow diverters 62, 64, and 66 to the rotating pre-filter 58 and disc-shaped rotating filter 56, respectively, causes an increase in the angular velocity of the liquid and results in a shear force being applied on the corresponding surface of the rotating pre-filter 58 and disc-shaped rotating filter 56. This applied shear force aids in the removal of soils on the rotating pre-filter 58 and disc-shaped rotating filter 56 and is attributable to the interaction of the liquid and the rotating pre-filter 58 and disc-shaped rotating filter 56. The increased shear force zones 92, 93, 94, 95 function to remove and/or prevent soils from being trapped on the surfaces of the rotating pre-filter 58 and disc-shaped rotating filter 56. The shear forces created by the increased angular acceleration and applied to the surfaces of the rotating pre-filter 58 and disc-shaped rotating filter 56 have a magnitude that is greater than what would be applied if the first, second and third flow diverters 62, 64, and 66 were not present.

Further, the first flow diverter 62 overlies a portion of the downstream surface 86 of the rotating pre-filter 58 to form a pressurized zone 96 there between and wherein liquid will backwash from the downstream surface 86 of the pre-filter to the upstream surface 85 of the rotating pre-filter 58 in response to the liquid pressurized zone 96 to form a backwash flow as indicated by the arrows 97. Essentially, the backflow is created due to pressure gradients within the filter chamber 42, which act to drive the liquid back through the rotating pre-filter 58 from the downstream surface 86 to the upstream surface 85. More specifically, the large width body portion 63 of the first flow diverter 62 causes a converging wedge of liquid that forms the liquid pressurized zone 96 and acts to force the liquid back through the rotating pre-filter 58 to clean the rotating pre-filter 58. The backwash flow aids in a removal of soils on the upstream surface 85 as the backwash flow lifts accumulated soil particles from the upstream surface 85 of at least a portion of the rotating pre-filter 58. Similarly, the second flow diverter 64 has a larger width body portion 65 overlying a portion of the downstream surface 84 of the disc-shaped rotating filter 56 and forms a pressurized zone 98 there between and wherein liquid will backwash from the downstream surface 84 to the upstream surface 83 in response to the pressurized zone 98 to form a backwash flow as indicated by the arrows 99.

It is also contemplated that the edges of the first and second flow diverters 62 and 64 may be staggered such that the second flow diverter 64 has a leading edge that precedes the leading edge of the first flow diverter 62 such that liquid may be backwashed across the disc-shaped rotating filter 56 filter just ahead of the first flow diverter 62. Similar staggering may also be utilized between the first and third flow diverters 62 and 66. This may aid in the creation of a low pressure zones (not shown) opposite the high pressure zones, which may further increase the pressure gradient and further increase the backwash flow of liquid.

The flow diverters 62, 64, and 66 may be shaped in a variety of ways to obtain a variety of attributes. For example, the first flow diverter 62 has been illustrated as including a scooped portion 67 facing the upstream surface 83. During operation, the scooped portion 67 may lift soil particles larger than the space 100 between the upstream surface 83 and the first flow diverter 62 away from the upstream surface 83 to effect a cleaning of the upstream surface 83. Further, the flow diverters 62, 64, and 66 have been illustrated as having a shape that may aid in inducing soil particles towards the periphery of the recirculation pump 39. The disc-shaped rotating filter 56 also produces some centrifugal force and that force along with the shape of the flow diverters 62, 64, and 66 pushes soil toward the periphery of the recirculation pump 39. That is, the flow of liquid caused by the first flow diverter 62 and the disc-shaped rotating filter 56 induces soil outward away from a center of the disc-shaped rotating filter 56 as illustrated by arrows 102. Similarly, the flow of liquid caused by the third flow diverter 66 and the rotating pre-filter 58 induces soil outward away from a center of the rotating pre-filter 58 as illustrated by arrows 104. Both the third flow diverter 66 and the rotating pre-filter 58 may act to deflect hard objects away from the disc-shaped rotating filter 56. Objects that hit the rotating pre-filter 58 will tend to be pushed out radially under guidance from the third flow diverter 66.

In this manner, there may be a radial outward flow established in front of the rotating pre-filter 58 and in between the disc-shaped rotating filter 56 and the rotating pre-filter 58. This will aid in cleaning the disc-shaped rotating filter 56 and rotating pre-filter 58. This flow will then go outward until it hits the outer wall of the filter housing 40 and will then move into the filter chamber 42. There may be a slightly lower pressure inside the inlet port 44 so liquid may move from the filter chamber 42 to inside the inlet port 44 to repeat the process again.

There are a variety of advantages of the present disclosure arising from the various features of the method, apparatuses, and system described herein. For example, the embodiments of the apparatus described above allows for enhanced filtration such that soil is filtered from the liquid and not redeposited on utensils. Further, the embodiments of the apparatus described above allow for cleaning of the filter throughout the life of the dishwasher and this maximizes the performance of the dishwasher. Thus, such embodiments require less user maintenance than required by typical dishwashers. Further, the rotating filter elements are located on the same axis as the stationary parts allowing for the impedance bars to be very close to the filters, which act to improve the effectiveness of the impedance bars. Further, such a configuration also allows for disassembly and reassembly of the flow diverters and rotating filters. Further, the liquid impelled by the filter assembly does not create a pressure gradient that opposes flow through the filter and this may reduce the power consumption for rotating the filter assembly. Further, the above described embodiments may allow for objects to be induced outward towards a periphery of the recirculation pump, which may improve the ability of the filter assembly to handle hard objects.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a treating chamber;

a liquid spraying system supplying a spray of liquid to the treating chamber;

a recirculation pump and filter assembly having a recirculation pump comprising an impeller and a filter housing having an inlet fluidly coupled to the tub and an outlet fluidly coupled to the liquid spraying system via the impeller of the recirculation pump to recirculate liquid from the tub to the treating chamber;

a planar disc-shaped filter mounted to the impeller for co-rotation with the impeller and located within the filter housing between the inlet and the outlet and completely fluidly separating the inlet from the outlet such that liquid flowing from the inlet to the outlet must pass through the rotating planar disc-shaped filter from an upstream surface to a downstream surface such that fluid on an upstream side of the planar disc-shaped filter defines a first part that contains filtered soil particles and a downstream side of the planar disc-shaped filter defines a second part that excludes filtered soil particles; and a first flow diverter spaced from the upstream surface to induce soil outward away from a center of the planar disc-shaped filter and towards a periphery of the planar disc-shaped filter, the first flow diverter having a scooped portion facing the upstream surface and the scooped portion lifts soil particles larger than the space between the upstream surface and the first flow diverter away from the upstream surface to effect a cleaning of the upstream surface;

wherein liquid passing between the first flow diverter and the upstream surface applies a greater shear force on the upstream surface than liquid in an absence of the first flow diverter.

2. A dishwasher comprising:

a tub at least partially defining a treating chamber;

a liquid spraying system supplying a spray of liquid to the treating chamber;

a recirculation pump and filter assembly having a recirculation pump comprising an impeller and a filter housing having an inlet fluidly coupled to the tub and an outlet fluidly coupled to the liquid spraying system via the impeller of the recirculation pump to recirculate liquid from the tub to the treating chamber;

a planar disc-shaped filter mounted to the impeller for co-rotation with the impeller and located within the filter housing between the inlet and the outlet and completely fluidly separating the inlet from the outlet such that liquid flowing from the inlet to the outlet must pass through the rotating planar disc-shaped filter from an upstream surface to a downstream surface such that fluid on an upstream side of the planar disc-shaped filter defines a first part that contains filtered soil particles and a downstream side of the planar disc-shaped filter defines a second part that excludes filtered soil particles;

a first flow diverter spaced from the upstream surface to induce soil outward away from a center of the planar disc-shaped filter and towards a periphery of the planar disc-shaped filter wherein liquid passing between the first flow diverter and the upstream surface applies a greater shear force on the upstream surface than liquid in an absence of the first flow diverter; and a second flow diverter overlying a portion of the downstream surface to form a pressurized zone there between and wherein liquid will backwash from the downstream surface to the upstream surface in response to the pressurized zone to form a backwash flow.

3. The dishwasher of claim 2 wherein the first and second flow diverters are s-shaped.

4. The dishwasher of claim 2 wherein the first and second flow diverters are arranged such that they have matching orientations on opposite sides of the disc-shaped filter.

5. The dishwasher of claim 2, further comprising a pre-filter in a spaced relation from the disc-shaped filter and the first flow diverter such that the pre-filter fluidly separates the inlet from the disc-shaped filter such that liquid flowing from the inlet to the disc-shaped filter must pass through the pre-filter from an upstream surface to a downstream surface.

6. The dishwasher of claim 5 wherein the pre-filter includes a disc-shaped top and a peripheral wall extending from the disc-shaped top towards the disc-shaped filter and wherein a bottom of the peripheral wall is mounted to the impeller.

7. The dishwasher of claim 6 wherein openings in the peripheral wall of the pre-filter are larger than openings in the disc-shaped top of the pre-filter.

8. The dishwasher of claim 7 wherein the pre-filter is a coarse screen filter and the disc-shaped filter is a fine screen filter.

9. The dishwasher of claim 7, further comprising a third flow diverter spaced from the upstream surface of the pre-filter such that a flow of liquid caused by the third flow diverter induces soil outward away from a center of the pre-filter.

10. The dishwasher of claim 9, wherein the third flow diverter applies a greater shear force on the upstream surface of the pre-filter than liquid in an absence of the third flow diverter.

11. The dishwasher of claim 10 wherein the first flow diverter overlies a portion of the downstream surface of the pre-filter to form a pressurized zone there between and wherein liquid will backwash from the downstream surface of the pre-filter to the upstream surface of the pre-filter in response to the pressurized zone to form a backwash flow.

12. The dishwasher of claim 10 wherein the third flow diverter is S-shaped and the first and third flow diverters are arranged such that they have matching orientations on opposite sides of the pre-filter.

13. The dishwasher of claim 12 wherein the first and second flow diverters are s-shaped.

14. The dishwasher of claim 13 wherein the first and second flow diverters are arranged such that they have matching orientations on opposite sides of the disc-shaped filter.

15. The dishwasher of claim 12 wherein the third flow diverter includes a hollow coupler that may be mounted to the inlet of the recirculation pump.

16. The dishwasher of claim 15, further comprising a shaft operably coupled to the hollow coupler and upon which the first and second flow diverters are mounted.

17. A dishwasher comprising:

a tub at least partially defining a treating chamber;

a liquid spraying system supplying a spray of liquid to the treating chamber; and a recirculation pump and filter assembly having a recirculation pump comprising an impeller, which has a front end defining an inlet opening, and a filter housing having an inlet fluidly coupled to the tub and an outlet fluidly coupled to the liquid spraying system via the impeller of the recirculation pump to recirculate liquid from the tub to the treating chamber;

a planar disc-shaped filter mounted along a periphery of the planar disc-shaped filter to the front end of the impeller for co-rotation with the impeller about an axis of rotation and located within the filter housing between the inlet and the outlet and completely fluidly separating the inlet from the outlet such that liquid flowing from the inlet to the outlet must pass through the rotating planar disc-shaped filter from an upstream surface to a downstream surface such that fluid on an upstream side of the planar disc-shaped filter defines a first part that contains filtered soil particles and a downstream side of the planar disc-shaped filter defines a second part that excludes filtered soil particles;

a stationary shaft located along the axis of rotation of the planar disc-shaped filter; and a first flow diverter mounted to the stationary shaft and spaced from the upstream surface of the planar disc-shaped filter and where the first flow diverter is configured to induce soil outward away from a center of the planar disc-shaped filter and towards the periphery of the planar disc-shaped filter;

wherein liquid passing between the first flow diverter and the upstream surface applies a greater shear force on the upstream surface than liquid in an absence of the first flow diverter.

* * * * *